US005711435A

United States Patent [19]

Morison et al.

[11] Patent Number: 5,711,435

[45] Date of Patent: Jan. 27, 1998

[54] FAUCET DISPLAY UNIT AND METHOD OF FORMING SHELF FOR USE WITH SAME

[75] Inventors: Jim Morison, Oshawa; Paul Whittington, Thornhill, both of Canada

[73] Assignee: Peerless Home Products Inc., Mississauga, Canada

[21] Appl. No.: 423,111

[22] Filed: Apr. 14, 1995

[51] Int. Cl.[6] ..... A47F 5/08

[52] U.S. Cl. ..... 211/90; 211/94; 248/223.41; 248/220.22

[58] Field of Search ..... 211/87, 60.1, 94, 211/90, 63; 40/5; 248/223.41, 224.51, 298.1, 220.22

[56] References Cited

U.S. PATENT DOCUMENTS 5,392,934 2/1995 Fox ..... 248/220.31

*Primary Examiner*—Kenneth J. Dorner
*Assistant Examiner*—Curtis Cohen
*Attorney, Agent, or Firm*—Bereskin & Parr

[57] ABSTRACT

A faucet display unit for displaying watertaps, showerheads and the like. The display unit comprises a shelf having a display surface with first and second edges. At least one row of apertures is defined in the display surface for facilitating attachment of the faucets. A plurality of clips are slidably attached to a track located on the first edge of the shelf for connecting the shelf to a pegboard wall or a slot wall. A plurality of tracks are provided on the shelf for receiving cards that display product information or that cover unused apertures. In a first embodiment, the shelf extends in a downward slope relative to the wall. In a second embodiment, the shelf extends generally vertically relative to the wall.

21 Claims, 4 Drawing Sheets

INFO
INFO

FAUCET DISPLAY UNIT AND METHOD OF FORMING SHELF FOR USE WITH SAME

FIELD OF THE INVENTION

The present invention relates to shelving units and merchandisers for the retail display of faucets.

BACKGROUND OF THE INVENTION

Faucets, such as watertaps and showerheads, are typically displayed at a retail setting on stands that allow a customer to see the faucets in their final assembled form.

One problem faced by retailers when displaying faucets is the amount of space occupied by the display. The fixed cost per square foot of retail space tends to be high and it is important for retailers to optimize the amount of products displayed in a given space. The display stands that are currently available for displaying faucets do not readily allow for such space optimization. Often, customized display stands are supplied by the individual faucet manufacturers or distributors for displaying their own line of faucets. Such customized display stands are not designed with the retailer's space optimization requirements foremost in mind. Also, such stands are not adapted to display the faucets of more than one manufacturer or distributor.

What is needed is a faucet display device that permits a retailer to optimize the number of faucets displayed in a given retail space. The display device would be sufficiently versatile to display a range of styles of faucets from different manufacturers or distributors, and would be available in a range of sizes. The display device would permit the display of product information adjacent to each faucet displayed. Also, the display device would be inexpensive to produce and simple to install to conventional retail fixtures.

SUMMARY OF THE INVENTION

In one aspect the invention provides a product merchandiser comprising:

a shelf having a display surface with first and second edges;

a plurality of apertures defined in said display surface for facilitating the attachment of a plurality of faucets to said shelf, each of said apertures being adapted to receive a portion of a faucet;

at least one clip adapted to engage an opening in a shelf support structure;

an attachment track extending along said first edge of said shelf, said attachment track including a pair of opposing flanges adapted to slidably support said clip, said flanges having faces that are oriented to engage said clip to position said display surface in a downward slope from said first edge to said second edge relative to said support structure; and means for attaching said shelf to a support structure.

In another aspect, the invention provides a faucet display unit comprising:

a shelf having a display surface with first and second edges;

a plurality of apertures defined in said display surface for facilitating the attachment of a plurality of faucets to said shelf, each of said apertures being adapted to receive a portion of a faucet; at least one clip adapted to engage an opening in a shelf support structure;

an attachment track extending along said first edge of said shelf, said attachment track including a pair of opposing flanges adapted to slidably support said clip, said flanges having faces that are oriented to engage said clip to position said display surface in a downward slope from said first edge to said second edge relative to said support structure; and means for attaching said shelf to a support structure.

Advantageously, the plurality of apertures defined in the display surface permits faucets to be arranged on the shelf in a way that optimizes the amount of product displayed per linear foot of wall space. In further aspects, the covering means and information display means permit the retailer to customize the shelf according to his own particular display requirements. The method of formation of the shelf by extrusion enables the shelf to be cost-effectively manufactured in a variety of desired lengths.

BRIEF DESCRIPTION OF THE DRAWINGS

For a better understanding of the present invention, and to show more clearly how it may be carried into effect, reference will now be made, by way of example, to the accompanying drawings. The drawings show a preferred embodiment of the present invention, in which.

DETAILED DESCRIPTION OF THE PREFERRED EMBODIMENT

Figure 3:
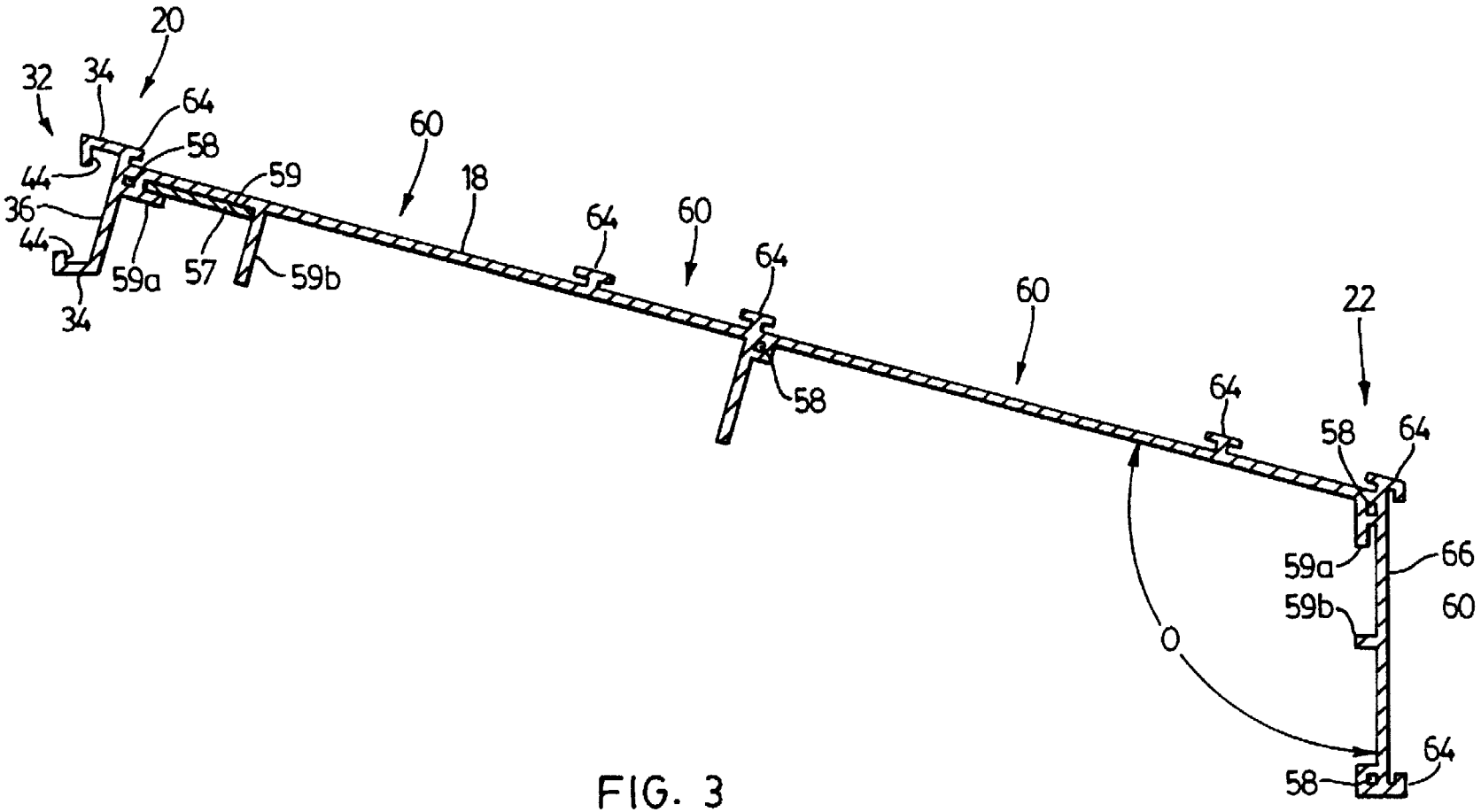
FIG. 3 shows a sectional view of the faucet display unit of FIG. 2 taken along lines 3—3.
Figure 4:
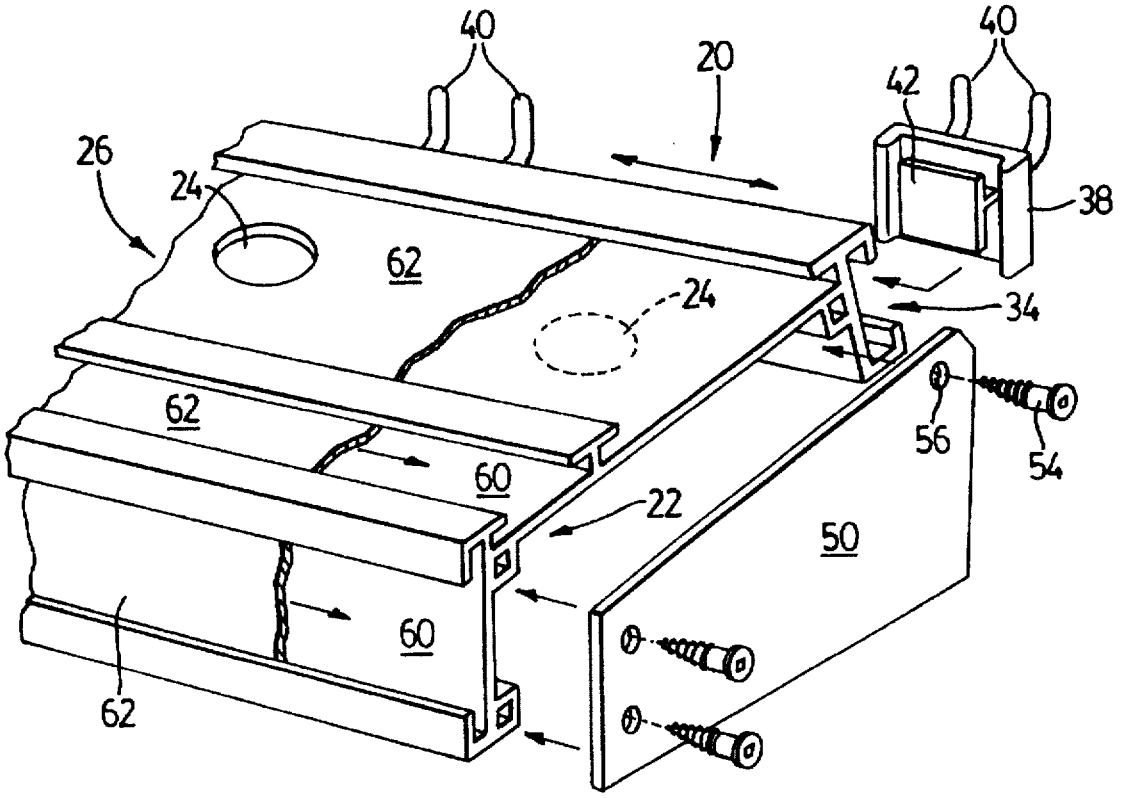
FIG. 4 shows a partial perspective view of the first embodiment of faucet display unit having a single row of apertures in accordance with the present invention.
Figure 6:
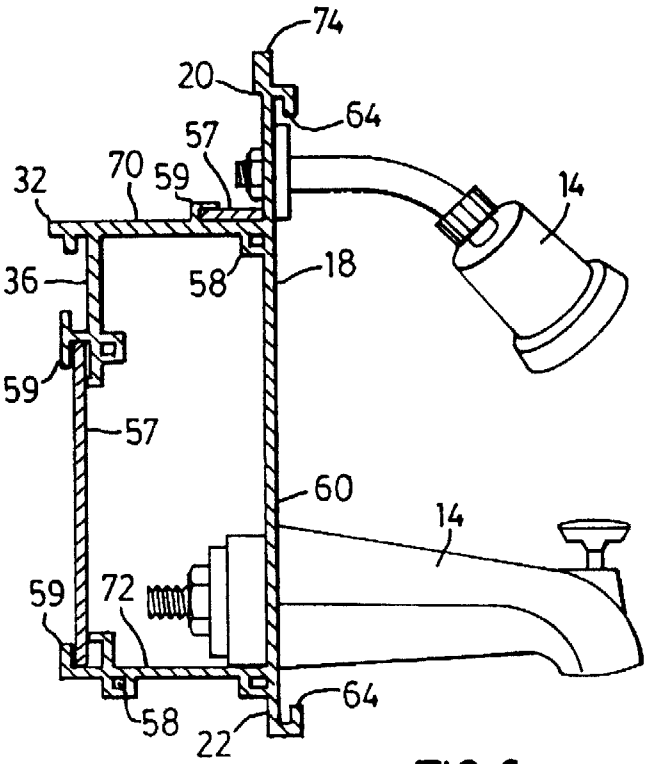
FIG. 6 is a sectional view of the second embodiment of display unit of FIG. 5 as taken along lines 6—6, said view further showing faucets mounted to the unit.
Figure 5:
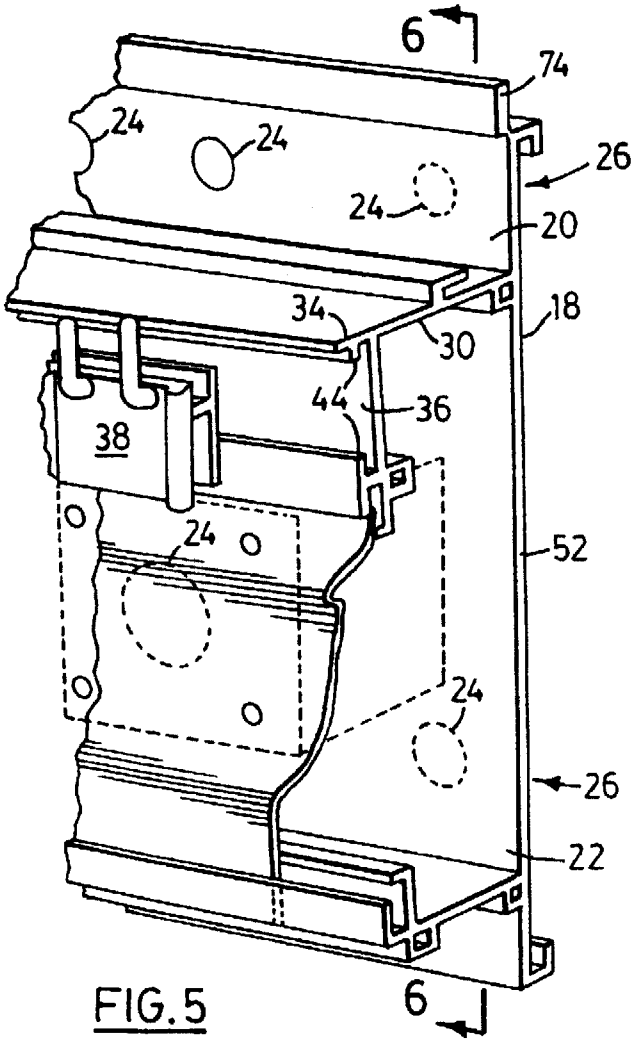
FIG. 5 shows a partial rear perspective view of a second embodiment of a faucet display unit in accordance with the present invention.

A faucet display unit in accordance with the present invention is shown generally at 10 in FIGS. 1 to 6. A first embodiment of the display unit 10 is shown in FIGS. 1–4. The first embodiment is particularly suited for displaying a plurality of faucets 14, such as counter-mounted water taps, that would be mounted on a horizontal surface. A second embodiment of the display unit 10 is shown in FIGS. 5–6. The second embodiment is particularly suited for displaying a plurality of faucets 14, such as showerheads and wall-mounted watertaps, that would be mounted on a vertical surface. For convenience, the same reference numerals are used to refer to similar functioning elements of both embodiments.

Figures 1, 2:
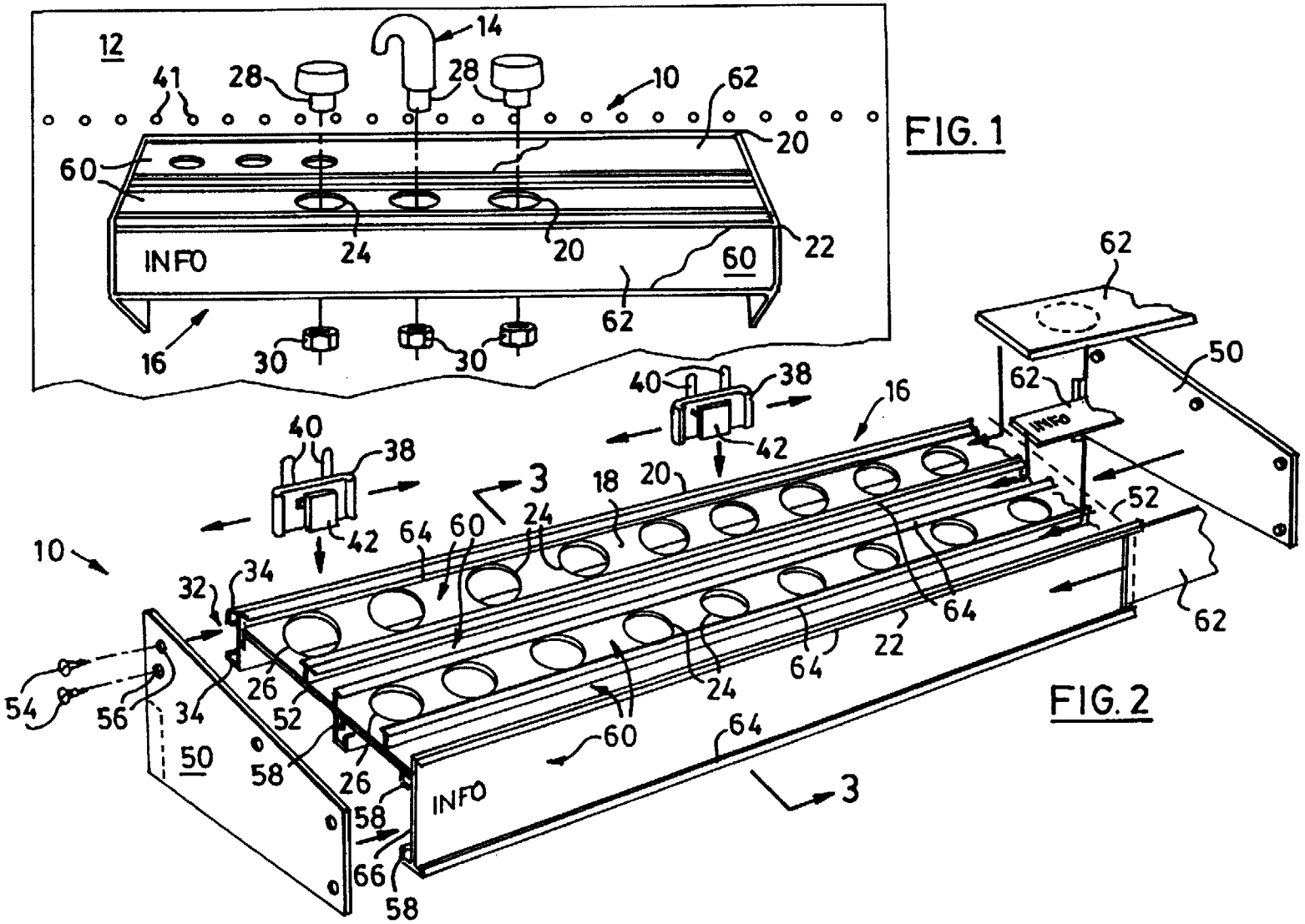
FIG. 1 shows a perspective view of a first embodiment of a faucet display unit having two rows of apertures in accordance with the present invention.
FIG. 2 shows an exploded perspective view of the faucet display unit of FIG. 1.

Referring to FIG. 1, the display unit 10 is depicted attached to a support structure 12 such as a pegboard wall or a slot wall commonly used in retail settings. Alternatively, the display unit 10 can be attached to a free standing support structure such as a pedestal or the like (not shown).

The display unit 10 includes a shelf 16 having a display surface 18 for displaying the faucets 14. The display surface 18 has a first edge 20 and a second edge 22. As will be explained further below, the shelf 16 is formed as a one piece extruded unit.

A plurality of apertures 24 are defined in the display surface 18. Each aperture 24 is sized to accommodate a wide variety of faucet styles and sizes. In the preferred embodiment, the apertures 24 have a diameter of approximately 1.5 inches which is sufficient to facilitate the display of most sizes of commercially available faucets 14.

Preferably, the apertures 24 are arranged in two rows 26 that extend parallel to the first edge 20 of the display surface 18. Alternative arrangements of apertures 24 may of course be provided, such as a single row of apertures 24 (as shown in FIG. 4), or three or more rows of apertures 24. The arrangement of apertures 24 selected depends upon factors such as the depth of the display surface 18 (the distance between the first edge 20 and the second edge 22), the size of the faucets 14 being displayed, and the preferred relative arrangement of faucets 14 on the shelf 16.

The apertures 24 are preferably spaced at four-inch intervals measured from the aperture centres. This corresponds to the standard sizing of watertaps in North America whose elements (e.g. hot and cold water handles, spout, etc.) are spaced at four-inch intervals.

As shown in FIG. 1, the faucets 14 are secured to the display surface 18 in generally the same way that they would be fitted to a countertop, a bathroom wall, or other surface during regular installation. In other words, a pipe connector 28 extending from the faucet 14 is inserted through aperture 24 and a corresponding locking nut 30 or the like is tightened to secure the faucet 14 to the shelf 16.

The display unit 10 is adapted to be attached to the support structure 12 (e.g. wall) along its first edge 20. A rear attachment member 32 is integrally connected to the first edge 20 to facilitate such attachment. As shown in FIG. 3, the rear attachment member 32 includes a pair of opposing flanges 34 that together define an attachment track 36 for slidably supporting wall attachment means such as clips 38 shown in FIG. 2. The clips 38 are known in the art for attaching items to peg board walls or slot walls. The clips 38 have prongs 40 adapted to fit into a slot or corresponding openings 41 in the wall 12. The clips 38 further include a tab 42 adapted to slidably fit into the track 36. The clips 38 may thus be slidably adjusted along the track 36 to provide a balanced support for the shelf 16 on the wall 12.

In the first embodiment of the display unit 10 depicted in FIGS. 1–4, the shelf 16 is preferably attached to the support structure 12 in such a way that the display surface 18 is oriented in a downward slope from its first edge 20 to its second edge 22. In this way, the full area of the display surface 18 may be seen by customers. This is preferred when the faucets 14 are arranged on several rows 26 so that customers may see all of the faucets, including those located at the rear of the shelf. Also, the sloping display surface 18 permits information materials to be placed adjacent to each faucet 14 and still be seen by a customer.

Referring more specifically to the attachment track 36 of the first embodiment, it can be seen that the flanges 34 have faces 44 that engage the tab 42 when the shelf 16 is attached to the support structure 12. As shown in FIGS. 3 and 4, the faces 44 are parallel to each other and are oriented at an acute angle A relative to the display surface 18. As a result, when the shelf 16 is attached to a vertical support structure 12, the display surface will extend in a downward slope at the acute angle A relative to the support structure 12. The angle A of the sloping display surface is preferably about 75°. It will be appreciated that alternative acute angles may be chosen depending on such factors as the intended display height of the shelf (i.e. what an average height customer might be expected to see), the depth of the display surface 18 from first edge 20 to second edge 22, and the number of rows 26 of apertures defined in the display surface 18. It will be noted that the profile of the attachment track 36 (as shown in FIG. 3) is selected to align the clips 38 at a suitable angle to facilitate easy mounting of the shelf 16 to the support structure 12.

A support 50 is attached to each of the ends 52 of the shelf 16 to improve the rigidity of the display unit 10. The supports 50 may be attached with any suitable attachment means such as glue, welds, rivets, plugs or the like. In the preferred embodiments, screws 54 are used. The screws 54 extend through openings 56 defined in the support 50, and are received in corresponding bores 58 defined in the shelf 16 and exposed at the ends 52, as shown in FIG. 3. The bores 58 have a smaller internal diameter than the diameter of the external thread of the screws 54 so that the screws 54 will tap into, and hold securely within, the bores 58.

Additional rigidity is provided to the display unit 10 by the optional insertion of stiffening braces 57 into corresponding brace tracks 59 defined on the underside of the shelf 16. The stiffening braces 57 are formed from sheet metal, or from any other material that is suitably rigid to restrict deflection of the shelf 16 caused by the weight of the faucets 14. As shown in FIG. 3, the brace tracks 59 are formed from an L-shaped flange **59*a*, for slidably receiving one edge of the stiffening brace 57, and a post 59*b*, for abuttably supporting the other edge of the stiffening brace 57. Alternatively, the brace tracks 59 could be formed from opposing pairs of L-shaped flanges 59*a***.

The shelf 16 also includes a series of display tracks 60 for facilitating the removable attachment of cards 62, also known as "tickets", containing product information to the shelf 16. The display tracks 60 are defined by pairs of flanged strips 64 having either an L-shaped cross-section or a T-shaped cross-section. The cards 62 are slidably inserted into the display tracks 60 where desired. As shown in FIG. 2, the display tracks 60 may be arranged to permit the cards 62 to cover unused apertures to improve the appearance of the display unit 10. Other means for covering the apertures 24 may be used instead, for instance plugs (not shown) may be adapted to fit into the apertures 24.

In the first embodiment shown in FIGS. 1–4, a further display track 60 is located on a front display skirt 66 that extends downwardly from the second edge 22 of the display surface 18. The skirt 66 is oriented at an obtuse angle O relative to the display surface 18 so that it will be generally vertical when the shelf 16 is attached to the support structure. Accordingly, angle O will generally be related to angle A. In the preferred embodiment angle O is 105° (with angle A being 75°).

Referring to FIGS. 5–6, a second embodiment of the display unit is shown. As previously indicated, the second embodiment is particularly suited for displaying showerheads and wall-mounted taps that would be mounted on a vertical surface.

It will be seen that the second embodiment of display unit 10 includes many of the same elements as the first embodiment. In certain cases, the orientation of the elements differs from the orientation in the first embodiment. This is due to the display surface 18 being adapted to extend generally vertically. Accordingly, the rear attachment member 32 is located on an upper arm 70 extending rearwardly from the display surface 18. Also, the faces 44 of the flanges 34 of the attachment track 36 are oriented parallel to the display surface 18 to facilitate attachment to the support surface 12 with the display surface 18 oriented vertically.

The apertures 24 are arranged in two rows 26. One of the rows 26 is located on an upper side of the display surface 18, preferably between the first edge 20 and the rearwardly extending upper arm 70. The faucets 14 attached to the upper row 26 of apertures 24 may therefore rely upon the torsional support provided by the abutment of the upper arm 70 and attachment member 32 against the support structure 12. The other row 26 of apertures 24 extends along a lower side of the display surface 18. Supports (not shown) attached to the ends 52 of the shelf 16 improve the rigidity of the display unit 10 and in particular support the lower row 26 of apertures. Additional support is provided by the stiffening braces 57 which may be inserted in the corresponding brace tracks 59 as shown. It will be noted that a second arm 72 extends rearwardly from the lower portion of the shelf 16 to support part of the brace track 59 as well as to define openings 58 for the support screws 54. The second arm 72 also provides torsional support for the lower row of faucets 14 by abutment against the support structure 12. Lastly, it will be noted that the stiffening brace 57*a* depicted in FIGS. 5 and 6, provides a mounting surface for securing the faucets to.

A lip 74 is defined along the first edge 20 of the display surface 18 to facilitate vertical stacking of display units 10 in a modular format. It will also be noted that the display track 60 is defined on the display surface 18 by flanges 64 for receiving display cards 62.

Referring to both embodiments as shown in FIGS. 3 and 6, it may be seen that the shelf 16 is formed as a one-piece unit. The shelves may be formed from a semi-sold metal or plastic by extrusion. A die for forming an extruded shelf as shown in FIGS. 3 or 6 would have a die opening resembling the section of the shelves 16 as depicted in the respective Figures. The extrusion would thus define the rear attachment member, display surface, and (for the first embodiment) display skirt of the shelf 16. Also, the extrusion would define the attachment track, brace tracks, display tracks, and screw openings of the shelf. The shelf 16 may thus be formed relatively inexpensively to any length desired. Once the extruded shelf is formed and cooled, the apertures 24 are cut into the display surface 18 in the locations desired.

It is to be understood that what has been described is a preferred embodiment to the invention. If the invention nonetheless is susceptible to certain changes and alternative embodiments fully comprehended by the spirit of the invention as described above, and the scope of the claims set out below.

We claim:

1. A faucet display unit comprising:

a shelf having a display surface with first and second edges;

a plurality of apertures defined in said display surface for facilitating the attachment of a plurality of faucets to said shelf, each of said apertures being adapted to receive a portion of a faucet;

at least one clip adapted to engage an opening in a shelf support structure; and an attachment track extending along said first edge of said shelf, said attachment track including a pair of opposing flanges adapted to slidably support said clip, said flanges having faces that are oriented to engage said clip to position said display surface in a downward slope from said first edge to said second edge relative to said support structure.

2. A display unit as claimed in claim 1, further comprising means located on said shelf for removably attaching product information materials to said shelf.

3. A display unit as claimed in claim 1, wherein said apertures are arranged in at least one row transversely along said shelf parallel to said first edge.

4. A display unit as claimed in claim 1, further comprising means for covering apertures that are not being used to attach said faucets.

5. A display unit as claimed in claim 2, wherein said product information attachment means comprises at least one display track adapted to slidably receive a card containing said product information.

6. A display unit as claimed in claim 5, wherein said display track includes a pair of opposing parallel flanged strips extending from said display surface of said shelf.

7. A display unit as claimed in claim 1, wherein a support is connected to each end of said shelf to add rigidity to the display unit.

8. A display unit as claimed in claim 1, wherein braces for stiffening said shelf are attachable to the underside of said shelf.

9. A display unit as claimed in claim 1, wherein a plurality of rows of apertures is provided.

10. A display unit as claimed in claim 1, wherein a front display skirt depends from said second edge of said shelf, said front display skirt containing at least one said display track for slidably receiving product information cards.

11. A display unit as claimed in claim 1, wherein said rear attachment member, said attachment track, said display surface, said front display skirt, and said display track of said shelf are integrally formed.

12. A faucet display unit comprising:

a shelf having a display surface with first and second edges;

a plurality of apertures defined in said display surface for facilitating the attachment of a plurality of faucets to said shelf, each of said apertures being adapted to receive a portion of a faucet;

at least one aperture cover removably mounted to said shelf, said aperture cover defining a non-apertured surface, for completely covering from view one or more of said apertures that are otherwise visible on said display surface; and means for attaching said shelf to a support structure.

13. A display unit as claimed in claim 12, wherein said support structure attachment means are configured to orient said display surface relative to said support structure in a downward slope from said first edge to said second edge.

14. A display unit as claimed in claim 12, wherein said support structure attachment means comprises at least one clip connected to said first edge of said shelf and adapted to engage an opening defined in said support structure.

15. A display unit as claimed in claim 14, wherein a rear attachment member extends along said first edge of said shelf, said attachment member including an attachment track adapted to slidably receive at least one of said clips.

16. A display unit as claimed in claim 15, wherein said attachment track includes a pair of opposing flanges adapted to slidably support said clip, said flanges having faces that are oriented to engage said clip to position said display surface in a downward slope from said first edge to said second edge relative to said support structure.

17. A display unit as claimed in claim 12, wherein said attachment means are configured to orient said display surface generally parallel to said support structure.

18. A display unit as claimed in claim 17, wherein a lip is defined along said first edge to facilitate vertical stacking of one display unit upon another against said support structure.

19. A display unit as claimed in claim 18, wherein a lower arm extends from a rear surface of said shelf to provide torsional support to said display unit by abutment against said support structure.

20. A display unit as claimed in claim 19, wherein an upper arm extends from said rear surface of said shelf to support said attachment means.

21. A display unit as claimed in claim 12, wherein a pair of opposing flanged strips are located on said display surface for slidably receiving a card for covering at least one of said apertures.

* * * * *